US006109746A

United States Patent [19]

Jeanmaire et al.

[11] Patent Number: 6,109,746

[45] Date of Patent: Aug. 29, 2000

[54] DELIVERING MIXED INKS TO AN INTERMEDIATE TRANSFER ROLLER

[75] Inventors: David L. Jeanmaire, Brockport; Anthony R. Lubinsky, Penfield, both of N.Y.

[73] Assignee: Eastman Kodak Company, Rochester, N.Y.

[21] Appl. No.: 09/084,665

[22] Filed: May 26, 1998

[51] Int. Cl.[7] ..... B41J 2/01; G03G 15/10

[52] U.S. Cl. ..... 347/103; 399/239

[58] Field of Search ..... 101/483; 347/84, 347/95, 96, 100, 103; 427/256; 399/237, 238, 239

[56] References Cited

U.S. PATENT DOCUMENTS 4,022,617 5/1977 McGuckin .
4,555,478 11/1985 Reczek .
4,568,633 2/1986 Lovecchio .
4,833,530 5/1989 Kohashi ..... 358/75
5,011,811 4/1991 Shuttleworth .
5,364,415 11/1994 Lewis .
5,414,091 5/1995 Chinoporos .
5,443,945 8/1995 Williamson .
5,455,140 10/1995 Texter .
5,492,804 2/1996 Biavasco .
5,492,805 2/1996 Krepski .
5,645,888 7/1997 Titterington et al. ..... 427/256
5,771,810 6/1998 Wolcott ..... 101/483

*Primary Examiner*—Arthur T. Grimley
*Assistant Examiner*—Hoang Ngo
*Attorney, Agent, or Firm*—Raymond L. Owens

[57] ABSTRACT

A method for printing information on an image receiver includes metering and collecting amounts of different fluids which when mixed will provide an ink of a desired color; transferring the fluids to cells formed on a surface where they are mixed to provide an ink of a desired color; and transferring the ink from the cells to an image receiver.

6 Claims, 4 Drawing Sheets

DELIVERING MIXED INKS TO AN INTERMEDIATE TRANSFER ROLLER

FIELD OF THE INVENTION

The present invention relates to printers which use ink.

BACKGROUND OF THE INVENTION

Ink jet printers, of both the drop-on-demand and continuous jet type, have lately enjoyed popularity in several applications, because of their good quality and relatively low hardware cost. Within the drop-on-demand category, several printing technologies have been employed including "bubble jet", in which the pressure from an expanding gas bubble in a liquid chamber causes a drop to be ejected from an orifice; and "piezo", in which the pressure pulse used for drop ejection is created by a piezoelectric actuator. However, these prior printing technologies have certain disadvantages. First, there has been no means in the prior methods by which the lightness, or optical density, of the deposited ink layer could be continuously adjusted. This then necessitates the use of digital halftoning algorithms in order to achieve images of high quality. Second, since the rate at which printed area can be covered with ink droplets decreases as the square of the resolution, and since high image quality requires high resolution, there has been a problem in the prior methods with slow printing speed, especially for higher quality images. Third, the amount of colorant which is carried by a liquid drop to a receiver has been limited in the prior methods by the solubility of the colorant in the liquid carrier, resulting in excessive liquid deposition, curl, long drying time, and other problems.

SUMMARY OF THE INVENTION

It is an object of the present invention to provide a method which solves these various problems, and effectively prepares and delivers continuous-tone inks for subsequent transfer to a image receiver.

This object is achieved by a method for printing information on an image receiver comprising the steps of:

a) metering and collecting amounts of different fluids which when mixed will provide an ink of a desired color;

b) transferring the fluids to cells formed on a surface where they are mixed to provide an ink of a desired color; and c) transferring the ink from the cells to an image receiver.

The present invention solves several problems of the prior art by preparation of a continuous-tone ink jet drop on a intermediate roller prior to transfer to the receiver to make a digital hard copy print. It is particularly effective because the ink colorant mixing takes place on the surface of an intermediate drum, prior to ink transfer to an image receiver.

DETAILED DESCRIPTION OF THE INVENTION

Figure 1:
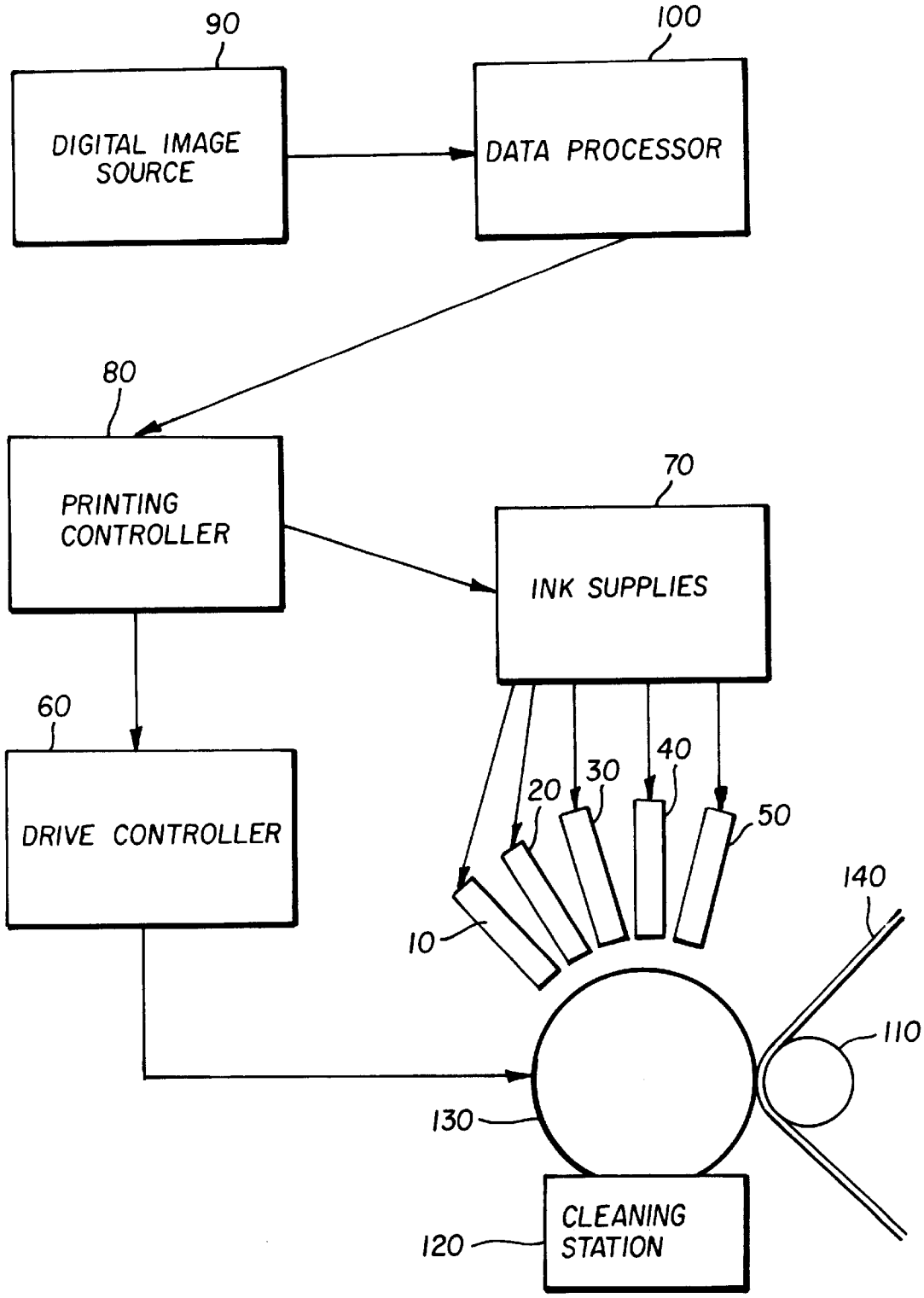
FIG. 1 shows a schematic of an apparatus which can practice the method of the present invention.

FIG. 1 shows an apparatus for printing images using five ink printheads 10, 20, 30, 40, and 50 where 10 is a printhead for delivering a yellow ink, 20 is a printhead for delivering a magenta ink, 30 is a printhead for delivering a cyan ink 40 is a printhead for delivering black ink, and 50 is a printhead for delivering an ink diluent to an intermediate transfer drum 130. The printheads are actually nozzles with the deliverance of fluids which, as noted above, can be inks or can be ink precursors which, when mixed together, form an ink. Whenever the term "ink" is used in this specification, it refers to a fluid which either has a particular color or can be mixed to form a desired color. In accordance with the present invention, fluids such as inks or ink precursors are delivered to the print heads. They are mixed in the cells of the transfer roller to provide the desired color. A series of ink reservoirs 70 supplies the inks or fluids to the printheads 10, 20, 30, 40 and 50.

In accordance with the method of operation of the present invention, digital data from digital image source 90, for example a computer, a digital scanner, or a disk drive, is transferred to the data processor 100. For example, data processor 100 calculates the required time of operation of parts internal to ink transfer printheads 10, 20, 30, 40 and 50 such as piezoelectric actuators, to be described, so that accurate color hue and intensity can be produced for viewing or for printing. To accomplish such calculations, data processor 100 uses information provided by the ink supply reservoirs 70, for example information of the colors and densities of inks in the ink supply reservoir 70, and receives such information through electrical interconnects. Printing controller 80 converts formatted data from the data processor 100 into electrical signals that control the operation of ink transfer printheads 10, 20, 30, 40 and 50. An intermediate transfer drum 130 is positioned directly underneath the ink transfer printheads 10, 20, 30, 40 and 50, and the drum is positioned via its associated drive controller 60. As the intermediate transfer drum rotates, ink from the printheads is delivered to cells on the drum surface where mixing occurs. Further rotation of the intermediate transfer drum 130 causes the cells filled with mixed inks to be brought into contact with the image receiver 140 which is pressed against the drum by receiver pressure roller 110. Transfer roller cleaning station 120 removes any residual ink from the cells in the transfer drum, thus preparing the drum surface for reuse.

Figure 2:
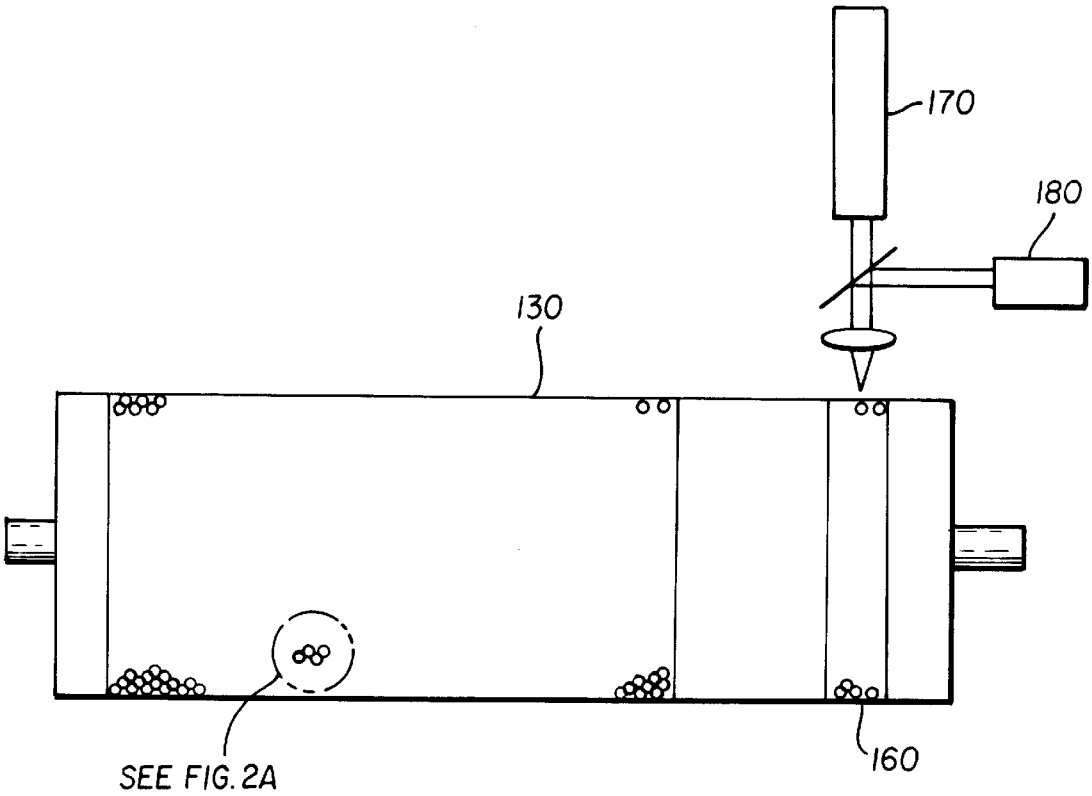
FIG. 2 shows a representation of the engraved the surface (providing cells) of the transfer roller of FIG. 1.
Figure 2A:
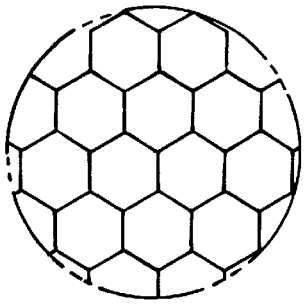

FIG. 2 shows the surface of a transfer roller engraved with a hexagonal structure as one embodiment of surface patterned cells. The term "cell" as used herein refers to an indentation in the surface of the transfer roller for collecting and mixing fluids. Other regular geometric patterns of surface relief can be used such as diamond, square, circular, etc. All of these surface relief patterns form cells. The distance between the centers of the cells in the pattern is equal to the printed dot pitch and the printhead nozzle pitch, which can be in a range from about 50 to 500 microns. The roller surface is constructed of materials well known in the printing industry, such as a metal, for example stainless steel or chromium, or a ceramic. A separate band of engraving 160 provides cells in a non-printing area of the drum for the purpose of establishing timing signals for synchronization of the printheads with the drum rotation. A diode laser source 170 emits light which is focused onto the drum surface. Reflections from the engraved cells are directed to detector photodiode 180.

Figure 3:
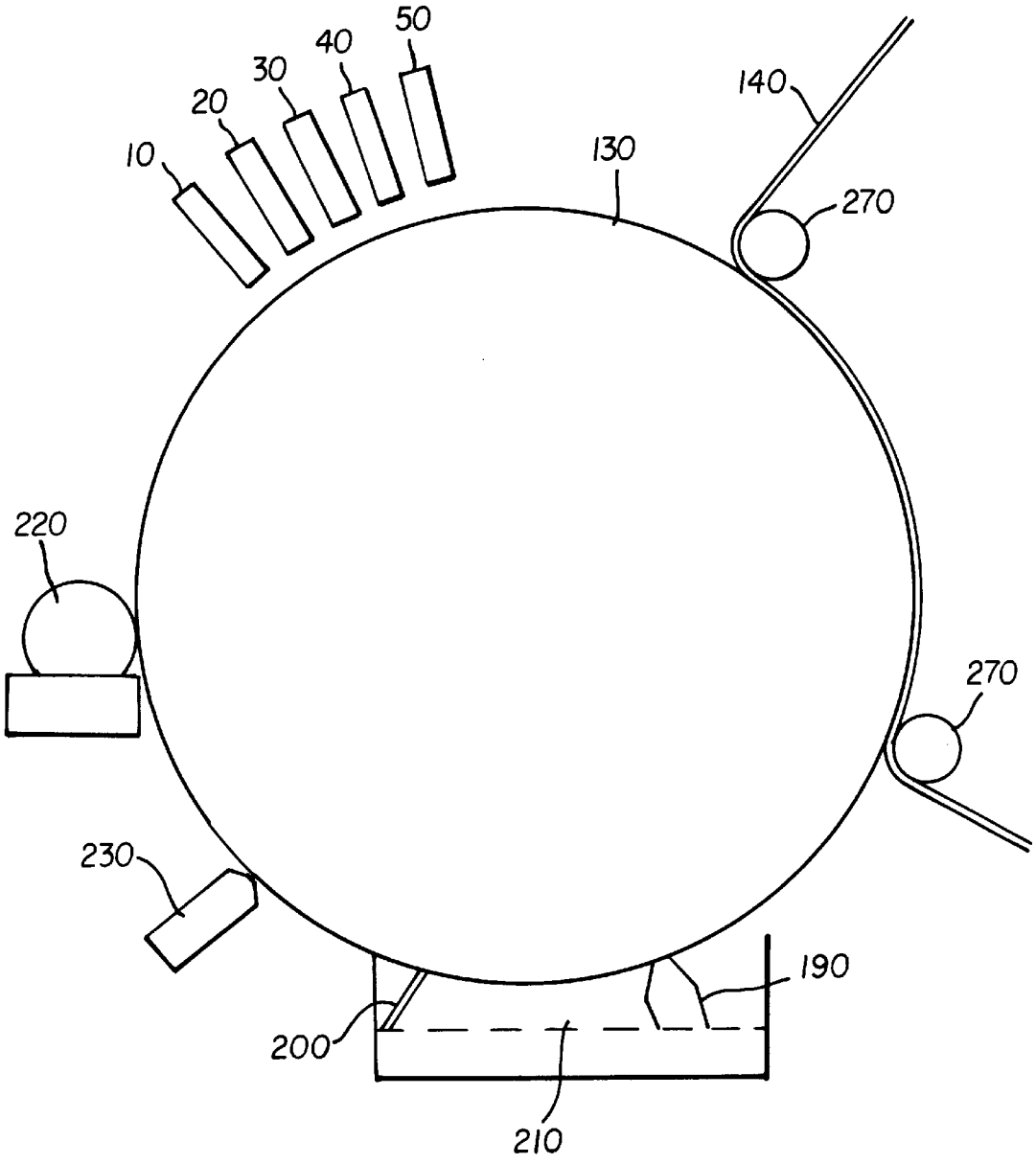
FIG. 3 shows a cross-sectional view of the transfer roller of FIG. 1 including peripheral elements.

A preferred embodiment of printing using a intermediate transfer drum 130 is shown in more detail in the schematic cross section of FIG. 3. Printheads 10, 20, 30, 40, and 50 are disposed around the periphery of the drum and are spaced between 0.1 and 4 mm, or more preferably 0.5 mm from the drum surface. Inks from the printheads are delivered to cells on the drum surface, where mixing occurs. Inks are then transferred to the image receiver 140. Tensioning rollers 270 hold the receiver against the drum surface, where the contact distance of the receiver against the drum is made sufficiently long to assure good ink transfer. Any ink remaining in the cells is removed in cleaning station 210, which consists of a jet of cleaning solvent spray station 190 followed by wiping with elastomeric blade 200. Air drying jet 230 removes any remaining solvent from the surface of the drum. Roller surface treatment station 220 consists of a roller and supply reservoir to spread an agent on the highest regions of the surface cell pattern on the transfer drum. This agent is to reduce the wetting of the surface by the ink, and thereby provide a barrier to ink flow into adjacent cells.

Figure 4:
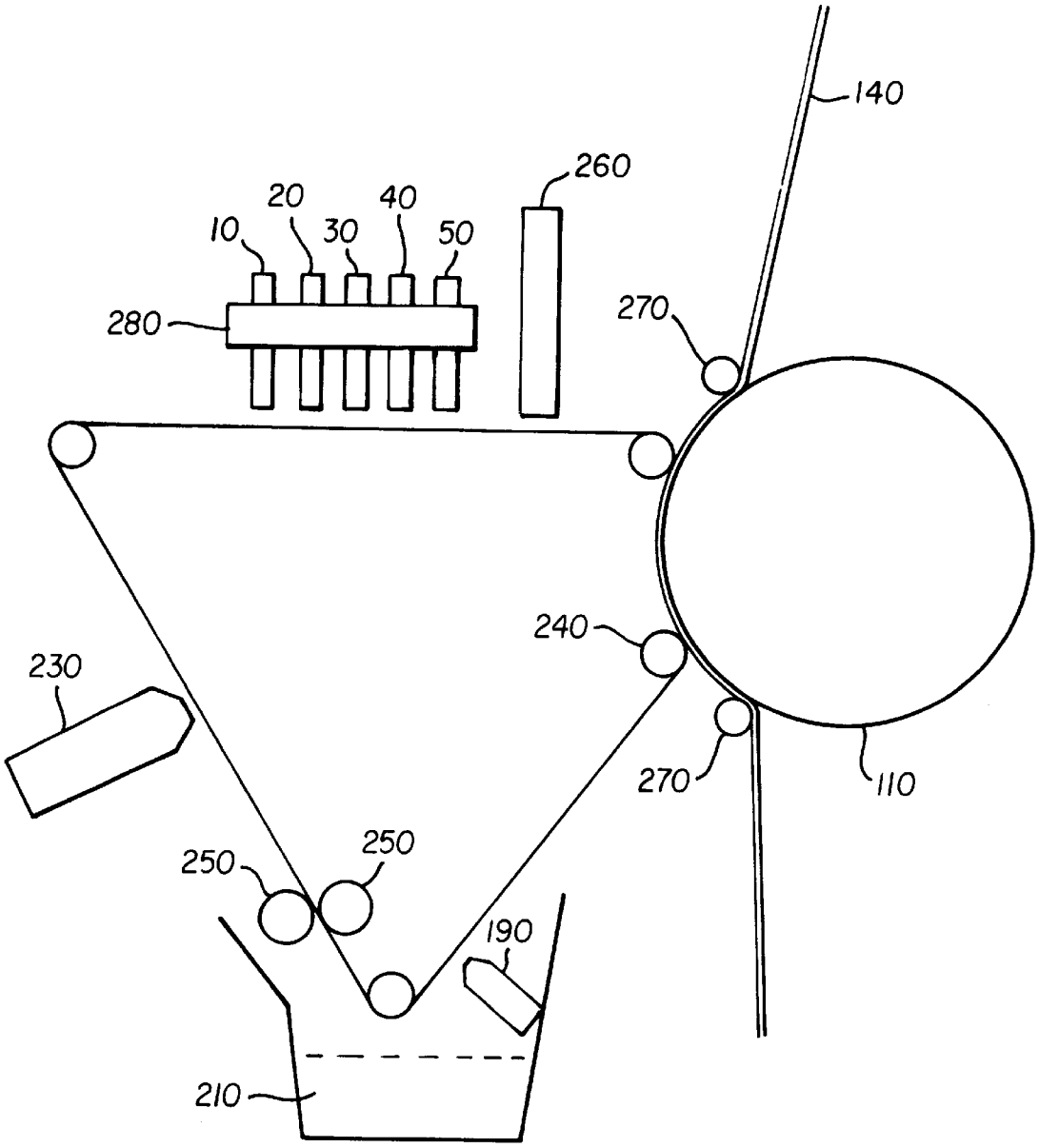
FIG. 4 is a view similar to FIG. 1 but showing another embodiment of the present invention.

FIG. 4 shows another embodiment of the present invention in which the intermediate transfer element is a continuous belt with a patterned surface. The belt is constructed with a steel core covered with an elastomeric layer into which are formed cells. This elastomeric material may be patterned to form cells with UV cross-linking technology which is well known in the art of printing by flexography. A band of patterned cells on the belt in a non-printing area is coated with a layer of aluminum, so that light synchronization sensor 260 can generate synchronization signals from light reflected from the belt surface. Ink is transferred from the printheads 10, 20, 30, 40 and 50 to the cells on the surface of the belt where mixing occurs. Mixed ink is then transferred to the surface of the image receiver 140, which is brought into contact with the belt by the use of tensioning rollers 270 and receiver pressure roller 110. The temperature of receiver pressure roller 110 may be controlled above room temperature, 25 to 80° C., or more preferably 35–55° C., to provide constant ink transfer characteristics. Printheads 10, 20, 30, 40, and 50 are mounted on a movable carriage, which is controlled by signals from light synchronization sensor 260 so that ink is delivered to the appropriate cells on the belt, thereby compensating for any side-to-side motion of the belt as it rotates. Cleaning station 210 consists of a jet of solvent 190 which is directed against the surface of the belt, followed by cleaning solvent removal rollers 250 which act to remove excess solvent from the belt. Air drying jet 230 further acts to remove solvent, thereby preparing the belt for re-inking.

The fluids which are delivered by printheads 10, 20, 30, 40, and 50 may be optionally, ink precursors, whereby mixing on the surface of the intermediate transfer drum causes the precursors to react and form the final inks. In the present invention, the term colorant precursor can include colorant precursors, colorant couplers, colorant developers, ligands and leuco dyes which can react with a reactant to form the correct color species. The colorant precursors can be colorless or colored. The reactant can be any of a wide range of chemistries. The reactant can be colored or colorless. If it is colored, a separate diluent chamber can be added to control densities. The diluent can either be a aqueous or organic solvent. The desired colors for printing are formed through the chemical reaction in the cells on the intermediate transfer drum.

In one example, the reactant can contain metal ions which can complex with the appropriate ligands to form the desired ink. The hue, saturation and lightness can be controlled by selection of the appropriate ligands to form the metal complex colorant. Examples of the chemistries have been published by "Analytical Applications of a 1,10-Phenenthroline and Related Compounds", A. Schilt, Pergammon Press, 54(1969) and "Theory and Structure of Complex Compounds", P. Krumholz, Oxford:Pergamon Press, 217 (1964). These chemistries have been incorporated in conventional photographic elements as demonstrated as disclosed in U.S. Pat. No. 4,555,478. Depending on the metal selected, the oxidation state of the metal can be maintained by either a reduction potential to maintain the reduced form (example $Fe^{2+}$ maintained from oxidizing to $Fe^{3+}$) or by oxygen deprivation. The ligands are very soluble, allowing for very high loading in their solute. The metal complex formed becomes virtually insoluble, especially if the complexing metal is attached to an organic moiety, for example, such as described in U.S. Pat. No. 4,568,633, or a polymeric species. More specifically, as shown in Table 1, a series of ligands are shown which can react with metal ions to form colored complexes. This example is shown for illustrative purposes only and does not limit the range of possible complexations or colorants. Examples of compounds that form colorants upon complexation with metal ions include hydrazones, tetrazolyl pyridines, benzimidazoles, pyridyl quinazolines, bisisoquinolines, imines, oximes, phenanthrolines, bipyridines, terpyridines, bidiazines, pyridyl diazines, pyridyl benzimidazoles, triazines, diazyltriazines, o-nitroso anilines and phenols, tetrazines, and quinazolines, imidazoles, triazolines and thiazolines to mention a few.

TABLE 1

| Ligand | Metal Ion | Color |
|---|---|---|
| 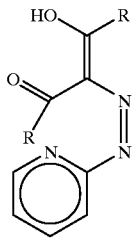 | $Ni^{2+}$ | Yellow |
| 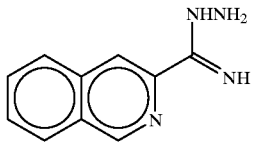 | $Fe^{2+}$ | Yellow |
| 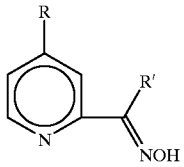 | $Fe^{2+}$ | Magenta |
| 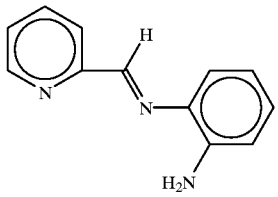 | $Fe^{2+}$ | Cyan |
| 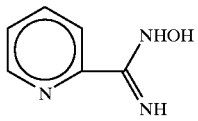 | $Fe^{2+}$ | Orange |
| 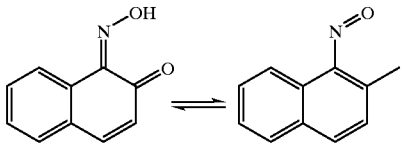 | $Fe^{2+}$ | Green |

wherein:

R and R' can be H, substituted or unsubstituted alkyl, aryl cycloalkyl, aryloxy, alkoxy, heterocyclyl or vinyl groups.

As is well known, reacting an electrophile with a coupler compound can form a dye. These chemistries have been successfully demonstrated in thermal printing with the in-situ formation of arylidene dyes in U.S. Pat. No. 5,011,811. More specifically, as shown in Table 2 below, there is shown a series of reactants to form colorants. In Table 2, the colorant precursors are electrophilic and the reactant is an arylidene coupler. The reaction produces dyes of the desired color.

TABLE 2

| Reactant | Colorant Precursors | Colorants (Dyes) |
|---|---|---|
| 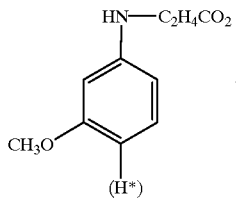 A | 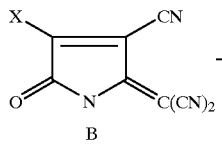 B | (cyan) 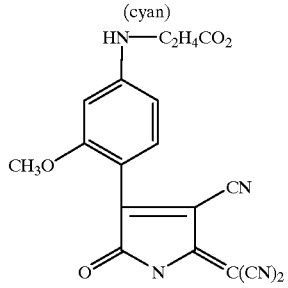 E |
| 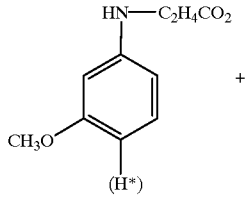 A | 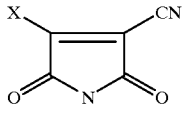 C | (magenta) 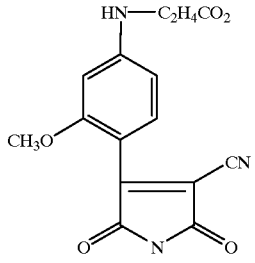 F |
| 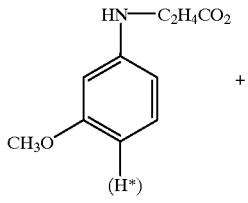 A | 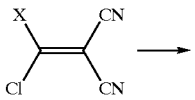 D | (yellow) 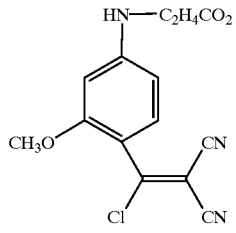 G |

In another example shown in Table 3, a common electrophile reactant reacts with different colorant precursors, which, in this case, are arylidene couplers to form yellow, magenta and cyan colorants, which in this case are arylidene dyes.

TABLE 3

| Reactant | Colorant Precursors | Color (Dye) |
|---|---|---|
| 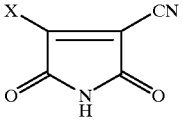 C | 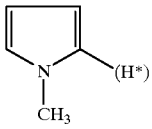 I | (yellow) 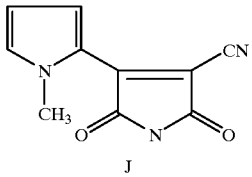 J (magenta) |

TABLE 3-continued

| Reactant | Colorant Precursors | Color (Dye) |
|---|---|---|
| 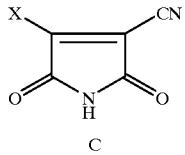 C | + 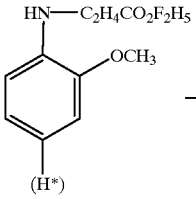 K | → 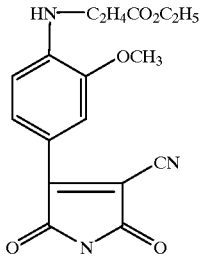 L (cyan) |
| 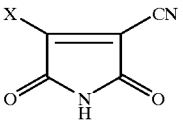 C | + 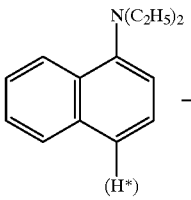 M | → 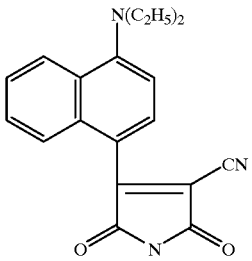 N |

In accordance with the present invention, the precursor and reactant can be either the electrophile or the coupler. By using a coupler and an electrophile, the solubility limit of the half colorant molecule in the solvent will be significantly higher than that of the fully formed colorant, allowing for higher solute loading in the solvent. This in turn permitting for using less fluid, reducing the system drying constraints and costs.

In a further example, color formation can be generated by the reaction of a stable diazonium salt and a separate stable coupler. The stable diazonium component and a stable coupler can be delivered separately via an inkjet head to an intermediate transfer drum where mixing subsequently occurs. The reaction of diazo salt with coupler is diffusion controlled as in the earlier examples, therefore is extremely fast with high conversion efficiency.

An example of diazonium:coupler reactions to provide the primary subtractive colors of yellow, magenta and cyan is illustrated in Table 4.

TABLE 4

| Diazonium salt | Coupler | Dye | Color |
|---|---|---|---|
| 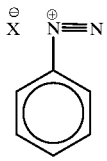 | 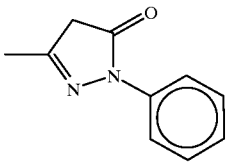 | 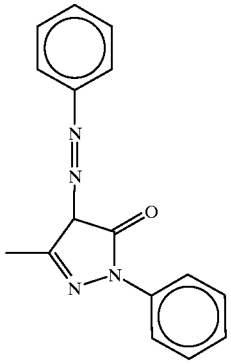 | Yellow |

TABLE 4-continued

| Diazonium salt | Coupler | Dye | Color |
|---|---|---|---|
| 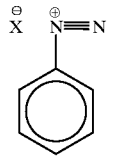 | 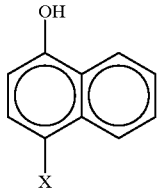 | 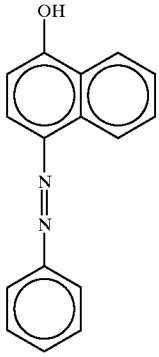 | Magenta |
| 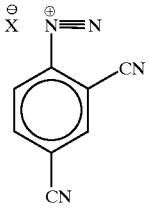 | 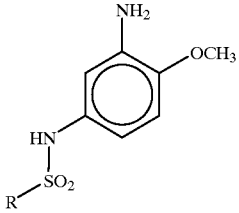 | 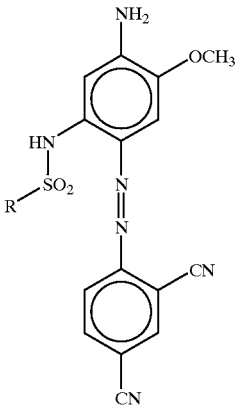 | Cyan |

wherein:

X can be $BF^{4-}$, a tosylate, a halide or any other salt; and

R can be H, substituted or unsubstituted alkyl, aryl cycloalkyl, aryloxy, alkoxy, heterocyclyl or vinyl groups.

The dyes in Table 4 are examples of stable, highly colored azo dyes that can be formed in the cells of the intermediate transfer drum.

Stable colorants can also be formed from leuco precursors in the cells of the intermediate transfer drum to generate yellow, magenta, cyan or specialty colors. U.S. Pat. No. 4,022,617 discloses the use of leuco dyes (or leuco base dyes) in photothermographic emulsions. Additional leuco dyes that are useful include those disclosed in U.S. Pat. Nos. 5,364,415; 5,492,804; and 5,492,805. The leuco form of the dye, which typically is virtually colorless, is oxidized either by electrical potential or by metal ions to form the stable colorant. In another embodiment of this system, the oxidant (reactant) can be in the receiver element allowing the color formation to take place after reactant transfer to the receiver. In this case the cells of the intermediate transfer drum are used to pre-mix the proper balance of leuco dyes (i.e., C, M and Y) to then be delivered to the receiver. Table 5 provides practical examples.

TABLE 5

| Leuco Form | Oxidant | Color |
|---|---|---|
| 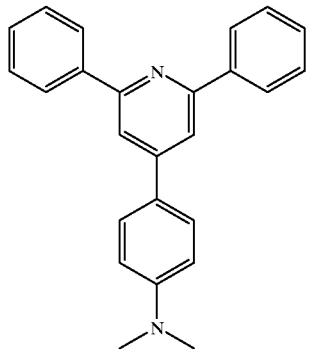 | $Zn^{2+}$ | Yellow |

TABLE 5-continued

| Leuco Form | Oxidant | Color |
|---|---|---|
| 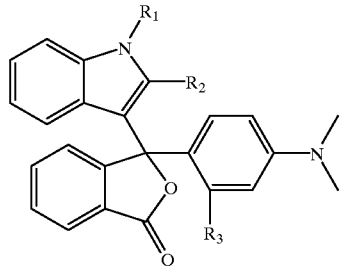 | $Zn^{2+}$ | Cyan |

wherein:

$R_1$, $R_2$ and $R_3$ can be H, substituted or unsubstituted alkyl, aryl cycloalkyl, aryloxy, alkoxy, heterocyclyl or vinyl groups.

It is understood that the above description is only intended to be an example of many possible chemistries that can be used in the present invention. For example, the chemistries disclosed in U.S. Pat. Nos. 5,414,091; 5,443,945; and 5,455,140 can be incorporated into the present invention. Other examples of related chemical systems can be found in "Analytical Applications of a 1,10-Phenenthroline and Related Compounds", A. Schilt, Pergammon Press, 54(1969) and "Theory and Structure of Complex Compounds", P. Krumholz, Oxford:Pergamon Press, 217 (1964). Furthermore, the colors formed by the colorant precursors are also not limited by the above examples. For instance, red, green, blue, orange or violet colorant precursors can also be included to form the respective colors, as disclosed by example in U.S. Pat. No. 5,011,811.

The invention has been described in detail with particular reference to certain preferred embodiments thereof, but it will be understood that variations and modifications can be effected within the spirit and scope of the invention.

PARTS LIST

| | |
|---|---|
| 10 | yellow colorant printhead |
| 20 | magenta colorant printhead |
| 30 | cyan colorant printhead |
| 40 | black colorant printhead |
| 50 | diluent printhead |
| 60 | drive controller |
| 70 | ink supply reservoirs |
| 90 | digital image source |
| 80 | printing controller |
| 100 | data processor |
| 110 | receiver pressure roller |
| 120 | transfer roller cleaning station |
| 130 | transfer drum |
| 140 | image receiver |
| 160 | band of engraving |
| 170 | laser light source |
| 180 | detector photodiode |
| 190 | cleaning solvent spray station |
| 200 | elastomeric blade |
| 210 | cleaning station |
| 220 | roller surface treatment station |
| 230 | air drying jet |
| 250 | cleaning solvent removal rollers |
| 260 | light synchronization sensor |
| 270 | tensioning rollers |

What is claimed is:

1. A method for printing information on an image receiver comprising the steps of:

a) metering and collecting amounts of different fluids which when mixed will provide an ink of a desired color;

b) transferring the fluids to cells formed on a surface where they are mixed to provide an ink of a desired color, the mixed fluids include ink colorant precursors or chemical reagents which react when mixed to form inks and a diluent so that the mixture of the inks and diluent provides a desired color; and c) transferring the ink and diluent from the cells to an image receiver where the transferred mixture provides the desired color.

2. The method in claim 1 wherein the mixed fluids are ink colorant precursors which react when mixed to form an ink of a desired color.

3. A method for printing information on an image receiver comprising the steps of:

a) metering and collecting amounts of different fluids which when mixed will provide an ink of a desired color;

b) transferring the fluids to cells formed on a surface of an intermediate transfer roller where they are mixed to provide an ink of a desired color, the mixed fluids include ink colorant precursors or chemical reagents which react when mixed to form inks and a diluent so that the mixture of the inks and diluent provides a desired color; and c) transferring the ink and diluent from the cells to an image receiver by pressing the image receiver against the transfer roller to facilitate the transfer of the ink to the receiver where the transferred mixture provides the desired color.

4. A method of claim 3 wherein the transfer of the fluids to cells is synchronized to the movement of the transfer roller.

5. A method for printing information on an image receiver comprising the steps of:

a) metering and collecting amounts of different fluids in separate spaced transfer nozzles, the fluids when mixed will provide an ink of a desired color;

b) transferring the fluids from the separate spaced nozzles to cells formed on a surface of an intermediate transfer roller where they are mixed to provide an ink of a desired color wherein the cells are spaced across the width of the transfer roller, and the spacing between the cells is substantially equal to or a multiple of the spacing between the transfer nozzles; and c) transferring the ink from the cells to an image receiver by pressing the image receiver against the transfer roller to facilitate the transfer of the ink to the receiver.

6. The method of claim 5 wherein the cell spacing is in a range from about 50 to 500 microns.

* * * * *